14-111 SR
10/22/85 OR 4,548,655

United States Patent [19]
Miller

[11] Patent Number: 4,548,655
[45] Date of Patent: Oct. 22, 1985

[54] METHOD FOR PRODUCING CUBE-ON-EDGE ORIENTED SILICON STEEL

[75] Inventor: Robert F. Miller, Evans City, Pa.

[73] Assignee: Allegheny Ludlum Steel Corporation, Pittsburgh, Pa.

[21] Appl. No.: 554,410

[22] Filed: Nov. 22, 1983

Related U.S. Application Data

[63] Continuation-in-part of Ser. No. 399,674, Jul. 19, 1982, abandoned.

[51] Int. Cl.[4] ..... H01F 1/04
[52] U.S. Cl. ..... 148/111; 148/112
[58] Field of Search ..... 148/111, 112, 31.55

[56] References Cited

U.S. PATENT DOCUMENTS

| | | | |
|---|---|---|---|
| 2,533,394 | 12/1950 | Oppenheimer et al. | 148/111 |
| 3,147,157 | 9/1964 | Grenoble | 148/111 |
| 3,287,184 | 11/1966 | Koh | 148/111 |
| 3,647,575 | 3/1972 | Fiedler et al. | 148/111 |
| 3,834,952 | 9/1974 | Matsushita et al. | 148/111 |
| 3,990,923 | 11/1976 | Takashina et al. | 148/111 |
| 4,251,296 | 2/1981 | Thornburg et al. | 148/120 |

FOREIGN PATENT DOCUMENTS 1393175 4/1972 United Kingdom .

*Primary Examiner*—John P. Sheehan
*Attorney, Agent, or Firm*—Patrick J. Viccaro

[57] ABSTRACT

An improvement in the manufacture of cube-on-edge oriented silicon steel; the improvement comprises decarburizing said steel followed by cold deformation prior to final texture annealing, whereby reduced watt loss is achieved.

5 Claims, No Drawings

METHOD FOR PRODUCING CUBE-ON-EDGE ORIENTED SILICON STEEL

This is a continuation-in-part application of application Ser. No. 399,674, filed July 19, 1982, now abandoned.

BACKGROUND OF THE INVENTION

This invention relates to a method of improving core loss in cube-on-edge oriented silicon steel at low inductions. More particularly, this invention relates to cold deformation of the decarburized strip before final texture annealing to reduce watt losses.

Cube-on-edge oriented silicon steel, in the form of sheets, is known for use in various electrical applications, including the manufacture of transformer cores. With cube-on-edge silicon steel the alloy is characterized by secondary recrystallization in the (110)[001] position, which is termed the cube-on-edge position. This material in sheet form has the direction of easy magnetization in the direction of rolling. In applications for this material, and specifically when used in the manufacture of transformer cores, the material is required to have reduced watt loss, because the consumption of electrical energy decreases as watt loss decreases. Reduced watt loss may be promoted by achieving fine secondary grain size during texture annealing.

It is accordingly an object of the present invention to provide a method whereby cube-on-edge silicon steel may be provided with a fine secondary grain or crystal structure after texture annealing, which achieves reduced watt loss.

This and other objects of the invention, as well as a more complete understanding thereof, may be obtained from the following description and specific examples.

SUMMARY OF THE INVENTION

In accordance with the present invention, a method is provided for reducing watt loss, including hot rolling, cold rolling to final gauge with intermediate annealing, normalizing the steel to decarburize and effect primary recrystallization and final texture annealing. The method includes uniformly providing a light cold deformation of the decarburized steel prior to final texture annealing to reduce grain size. The method is particularly useful for reducing core losses at low inductions of 15 kG or less. Also, the cold deformation may include cold rolling to effect elongations of the steel of 0.5% to 15% or reductions in area of 0.5% to 3%.

DETAILED DESCRIPTION OF THE PREFERRED EMBODIMENTS

With respect to cube-on-edge silicon steel to which the present invention is directed, this steel is conventionally processed by hot rolling followed by one or more cold rolling operations with intermediate anneals. After cold rolling, the steel is subjected to a normalizing operation to achieve primary recrystallization and decarburization. Typically, normalizing is conducted at temperatures within the range of 1300° to 1600° F. In accordance with the invention, after normalizing, the steel is subjected to uniform cold deformation as by a cold-rolling operation. After cold deformation, the steel is final texture annealed in the conventional manner to achieve secondary recrystallization. It has been found that by a light and uniform cold deforming in accordance with the invention following normalizing and prior to texture annealing, secondary grain growth is inhibited during final texture annealing, which results in reduced watt loss. For this purpose, cold rolling to achieve an elongation within the range of 0.5 to 15% has been found to be effective for the purpose. It has been found that by varying the amount of cold reduction of up to 5% reduction of area, the grain size after texture annealing may be regulated. Although the practice of the invention finds utility with cube-on-edge silicon steels, generally it is particularly adapted to steels of this type within the following composition limits in percent by weight:

| Steel | Mn | C | S | Si | B | Fe |
|---|---|---|---|---|---|---|
| SX-14 | .025–.045 | .020–.060 | .005–.040 | 2.70–3.50 | .0005–.0030 | Bal. |
| SX-11 | .050–.080 | .020–.060 | .020–.035 | 3.00–3.70 | — | Bal. |

EXAMPLE 1

By way of specific example, two Heats of the alloy identified SX-14 (Heat Nos. 154684 and 153595) were melted to the following composition in percent by weight:

| Heat No. | Mn | S | C | Si | B | Fe |
|---|---|---|---|---|---|---|
| 154684 | .036 | .019 | .028 | 3.21 | .0011 | Balance |
| 153595 | .038 | .020 | .025 | 3.25 | .0013 | Balance |

This material was processed in the conventional manner by hot rolling followed by a cold-rolling operation. Then it was subjected to a final normalizing treatment comprising continuous annealing at a temperature of 1475° F. (800° C.) which served to decarburize the steel and effect primary recrystallization. The normalized steel in strip form was cut to lengths suitable for cold rolling and rolled in a 4-high cold-rolling mill at ambient temperature. The extent of plastic deformation was determined by measuring the percent elongation over a 24" span scribed on the steel strip before cold rolling. For control purposes, samples of the steel were retained prior to cold rolling. The material was cut into standard Epstein strip samples and roller coated with a water slurry of MgO+0.75%B. Texture annealing was performed in dry hydrogen. The anneal cycle consisted of charging the steel into a furnace at 1400° F. (760° C.), heating at 50° F. (28° C.) per hour to 2150° F. (1175° C.), holding 20 hours at 2150° C. (1175° C.) and furnace cooling. Magnetic testing and grain size measurements were made after this texture annealing operation. Table I lists the magnetic properties and grain size of the material tested.

TABLE I

MAGNETIC PROPERTIES AND GRAIN SIZE (SX-14)

| Heat | Code | Elongation in % | Gauge Mils (mm) | WPP @ 17 KG | W/KG @ 1.7 T | μ at 10 Oe in G/Oe | B @ 796 A/m in T | Grain Size in mm |
|---|---|---|---|---|---|---|---|---|
| 153595 | A | 0 | 13.1 | .759 | 1.67 | 1913 | 1.91 | 16 |

TABLE I-continued

| MAGNETIC PROPERTIES AND GRAIN SIZE (SX-14) | | | | | | | | |
|---|---|---|---|---|---|---|---|---|
| Heat | Code | Elongation in % | Gauge Mils (mm) | WPP @ 17 KG | W/KG @ 1.7 T | μ at 10 Oe in G/Oe | B @ 796 A/m in T | Grain Size in mm |
| | (Control) | | (.33) | | | | | |
| | B | .5 | 13.2 (.33) | .777 | 1.71 | 1903 | 1.90 | 12 |
| | C | 1.3 | 13.1 (.33) | .773 | 1.70 | 1893 | 1.89 | 8 |
| | D | 3.1 | 12.8 (.33) | .796 | 1.76 | 1831 | 1.83 | 3 |
| | E | 4.7 | 12.8 (.33) | .877 | 1.93 | 1788 | 1.79 | 3 |
| | F | 17.7 | 11.4 (.29) | — | — | 1442 | 1.44 | Mixed |
| 154684 | A (Control) | 0 | 10.3 (.26) | .683 | 1.51 | 1928 | 1.93 | 14 |
| | B | .5 | 10.5 (.27) | .717 | 1.58 | 1866 | 1.87 | 5 |
| | C | 1.5 | 10.1 (.26) | .736 | 1.62 | 1842 | 1.84 | 4 |
| | D | 3.7 | 10.1 (.26) | .820 | 1.81 | 1774 | 1.77 | 2 |
| | E | 4.6 | 9.9 (.25) | .988 | 2.18 | 1678 | 1.68 | 1 |
| | F | 8.1 | 9.6 (.24) | 1.30 | 2.89 | 1519 | 1.52 | .4 |

The method of the present invention reduces both the permeability at high induction levels and the size of the grains formed during final texture annealing. The current trend in electrical steel usage is toward lower inductions and significant improvements have been made in lowering core losses or watt losses by reducing the sheet thickness. Commercially available material typically ranges from 0.014 to 0.011 inch (0.35 to 0.28 mm), and may be 0.009 inch (0.23 mm) and lower.

EXAMPLE 2

By Example 1, the cold reduction or temper rolling of decarburized silicon steel, demonstrates that the final annealed grain size in SX-14 compositions can be dramatically reduced. Further samples were prepared in a manner similar to the above Example to a nominal gauge of 10 mils to determine if core losses could be improved at lower inductions. The decarburized samples which were temper rolled to the specific percent reduction in area have the properties set forth in Table II.

TABLE II

| Heat | Code | % Reduction in Area | Core Loss (WPP) @ 13 KG | 17 KG | μ @ 10 H |
|---|---|---|---|---|---|
| 163012 | A (control) | 0 | .360 | .673 | 1906 |
| | B | 1 | .339 | .629 | 1900 |
| | C | 1 | .343 | .643 | 1896 |
| | D | 3 | .355 | .727 | 1829 |
| | E | 3 | .348 | .697 | 1850 |
| | F | 5 | .834 | .979 | 1709 |
| | G | 5 | .810 | .926 | 1724 |

At a 1% reduction in area of the decarburized strip, for Samples B and C there was a slight improvement (lowering) of the core loss at 17 kG and only a slight reduction in permeability at 10 oersteds. At 1% area reduction, the core losses at a lower induction of 13 kG are also improved. Samples D and E, which were given a 3% reduction in area, exhibited substantially increased core losses at 17 kG compared to the control Sample A having 0% reduction in area. The core losses at 13 kG are not as good as those for Samples B and C; however, they are better than the control Sample A at 0% reduction in area. These improvements are attributed to a substantially reduced grain size resulting from the cold reduction of the decarburized strip. For Samples F and G, a severe degradation in magnetic properties of core loss for inductions between 10 kG and 17 kG as well as for permeability at 10 H resulted from 5% reduction in area.

EXAMPLE 3

Additional samples of SX-14 were prepared and processed to nominally 9 mils in a similar manner as Examples 1 and 2. The hot-rolled band was annealed at 1750° F. (949° C.) for about 2 minutes, then air cooled and cold rolled to about 0.0086 inch. The samples were final normalized at 1475° F. (800° C.) in 80% $N_2$−20% $H_2$ atmosphere to decarburize the steel. Control samples were retained prior to cold rolling and other samples were rolled an additional 1, 2, 3 or 5% as shown in Table III. Epstein strip samples were prepared and coated with a water slurry of MgO+0.75% B. The samples were then final texture annealed in hydrogen in the laboratory by heating at 50° F. (28° C.) per hour to 2150° F. (1175° C.) and held for 10 hours and furnace cooled. The magnetic properties of the final texture annealed samples are shown in Table III.

TABLE III

| Heat | Code | % Temper Roll | Core Loss (WPP) @ 13 KG | 15 KG | 17 KG | μ @ 10 H |
|---|---|---|---|---|---|---|
| 189001 | A | 0 | .372 | .492 | .647 | 1900 |
| | | 1 | .368 | .503 | .681 | 1885 |
| | | 3 | .349 | .482 | .666 | 1886 |
| | B | 0 | .383 | .520 | .700 | 1878 |
| | | 1 | .404 | .561 | .816 | 1779 |
| | | 3 | .403 | .566 | .839 | 1766 |
| | C | 0 | .375 | .504 | .662 | 1896 |
| | | 1 | .377 | .513 | .686 | 1887 |
| | | 3 | .361 | .497 | .680 | 1869 |
| | D | 0 | .375 | .509 | .676 | 1887 |
| | | 1 | .373 | .517 | .737 | 1836 |
| | | 3 | .391 | .551 | .822 | 1788 |
| | E | 0 | .380 | .513 | .669 | 1892 |
| | | 2 | .378 | .515 | .699 | 1875 |
| | | 5 | .355 | .490 | .670 | 1888 |

TABLE III-continued

| Heat | Code | % Temper Roll | Core Loss (WPP) @ 13 KG | 15 KG | 17 KG | μ @ 10 H |
|---|---|---|---|---|---|---|
| | F | 0 | .368 | .499 | .678 | 1875 |
| | | 1 | .412 | .580 | .869 | 1752 |
| | | 3 | .397 | .554 | .823 | 1776 |
| 165365 | A | 0 | .362 | .477 | .633 | 1906 |
| | | 1 | .365 | .488 | .654 | 1889 |
| | | 3 | .342 | .458 | .612 | 1901 |
| | B | 0 | .350 | .476 | .657 | 1882 |
| | | 1 | .367 | .509 | .725 | 1838 |
| | | 3 | .383 | .542 | .813 | 1760 |

Samples A, C, D and E of Heat 189001 and Sample A of Heat 165365 all exhibited at least some improvement in core loss at 13 kG induction for reductions in area up to 5%. For those same samples, the core losses at a higher induction of 17 kG were worse. Samples A and E of Heat 189001 and Sample A of Heat 165365 have the most improved core losses with only slight reductions in permeability at 10 H. These improvements are attributable to a reduced grain size resulting from the cold reduction of the decarburized strip.

For Samples B and F of Heat 189001 and Sample B of Heat 165365, which exhibited little or no improvement in core loss at 13 kG induction, the grain size was either relatively unchanged, large or incomplete. This anomaly cannot be explained.

Most of the samples were temper rolled 1% or 3%, however, Sample E was cold rolled 2% and 5% and showed a significant reduction in losses up to 5% reduction with only a slight reduction in permeability at 10 H.

As such materials are used at lower inductions, on the order of 15 kilogauss or lower, the reduction in permeability at high inductions becomes less important in electrical equipment. Also, as the sheet thicknesses are reduced, core losses arising from eddy currents appear to be more dependent upon the material grain size, i.e., core losses decrease with decreasing grain size. The advantages of the present invention establish that it is of substantial importance in the manufacture of thin sheet, on the order of less than 0.015 inch to 0.004 inch (0.38 to 0.1 mm) thick, preferably less than 0.010 inch (0.25 mm) and suitable for use in transformers.

What is claimed is:

1. In a method for producing cube-on-edge oriented silicon steel, characterized by reduced watt loss, including the steps of hot rolling, cold rolling with intermediate annealing to final gauge, normalizing said steel to effect decarburization and primary recrystallization and a final texture annealing to effect secondary recrystallization, the improvement comprising providing a uniform light cold rolling deformation of 0.5 to 5% reduction in area of the decarburized steel prior to final texture annealing to reduce grain size.

2. The method of claim 1 wherein the cold rolling of the decarburized steel includes at least one cold-rolling operation.

3. The method of claim 2 wherein said cold rolling of decarburized steel effects a 0.5 to 3% reduction in area.

4. The method of claim 1 for reducing watt losses in the steel at inductions of 15 kG or less.

5. In a method for producing cube-on-edge oriented silicon steel, characterized by reduced watt loss, including the steps of hot rolling, cold rolling with intermediate annealing to final gauge, normalizing said steel to effect decarburization and primary recrystallization and a final texture annealing to effect secondary recrystallization, the improvement comprising providing a at least one uniform light cold rolling deformation to achieve a 0.5 to 15% elongation of the decarburized steel prior to final texture annealing to reduce grain size.

* * * * *